United States Patent [19]

Mansperger et al.

[11] Patent Number: 4,580,973

[45] Date of Patent: Apr. 8, 1986

[54] KILN WITH IMPROVED HEAT DISTRIBUTION

[75] Inventors: William L. Mansperger, Sonora; Donald M. Yamada, Stockton, both of Calif.

[73] Assignee: Ronald R. Yamada, Stockton, Calif.; a part interest

[21] Appl. No.: 628,937

[22] Filed: Jul. 9, 1984

[51] Int. Cl.[4] ..... F27B 17/00; F27B 9/00; F27D 23/00

[52] U.S. Cl. ..... 432/194; 432/148; 432/249

[58] Field of Search ..... 432/120, 148, 194, 241, 432/249

[56] References Cited

U.S. PATENT DOCUMENTS

| | | | |
|---|---|---|---|
| 750,600 | 1/1904 | Clark | 432/194 |
| 1,913,170 | 6/1933 | McCutcheon et al. | 432/194 |
| 2,225,166 | 12/1940 | Erby | 432/148 |
| 3,752,643 | 8/1973 | Robinson | 432/120 |
| 4,357,762 | 11/1982 | Eustacchio | 432/148 |
| 4,373,658 | 2/1983 | March et al. | 432/194 |

*Primary Examiner*—John J. Camby

*Attorney, Agent, or Firm*—Townsend & Townsend

[57] ABSTRACT

A kiln producing a uniform temperature distribution within the kiln heating chamber and enabling maximum use of heating chamber volume. The heat source is provided by a high-velocity flow of heating gas, which is introduced into the heating chamber through an orifice in a chamber wall. A deflector plate is positioned proximate to, and spaced apart from, the chamber wall so as to overlie the orifice in the path of the high-velocity flow. The dimensions and spacing of the deflector plate may be chosen so as to produce a flow of heat gas primarily parallel to the adjacent wall of the heating chamber and so that the parallel flow will maintain its substantial integrity along the wall much beyond the extremities of the deflector plate. Appropriately positioned gas-entrance ports with associated deflector plates in the kiln are found to produce a uniform temperature distribution without the sacrifice of otherwise usable heating chamber volume.

10 Claims, 6 Drawing Figures

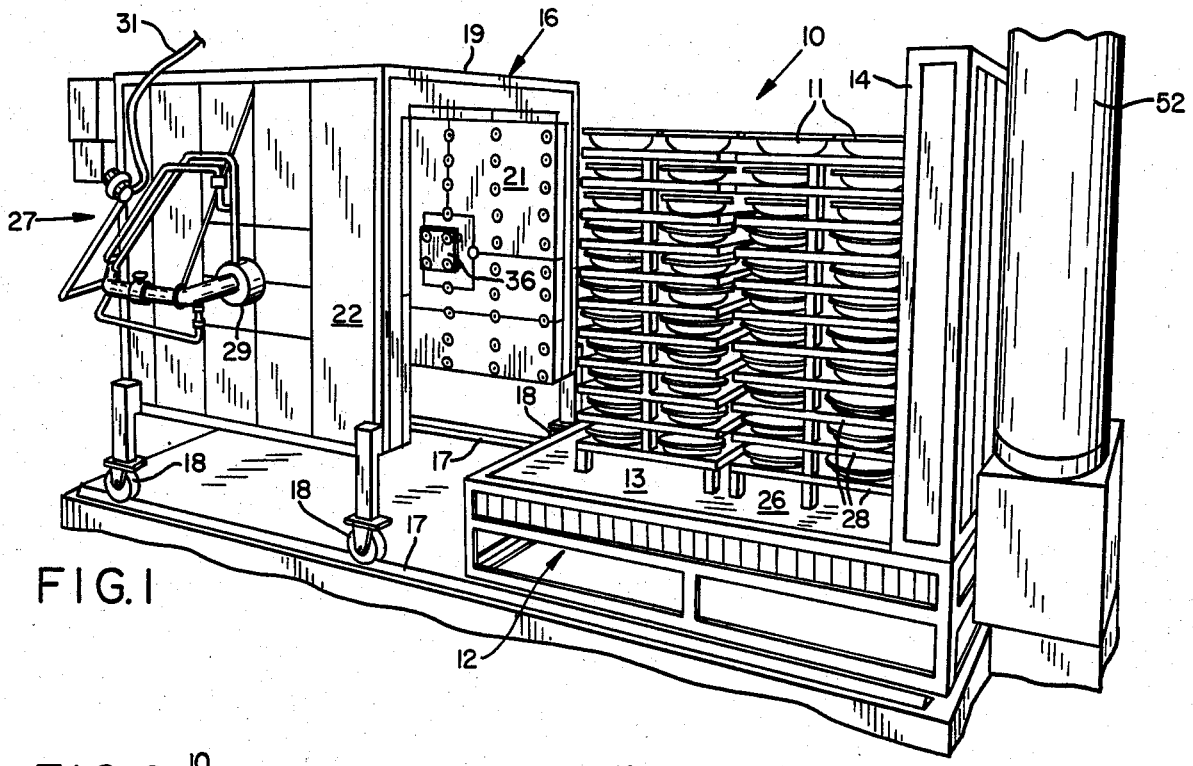
FIG. 1
FIG. 2
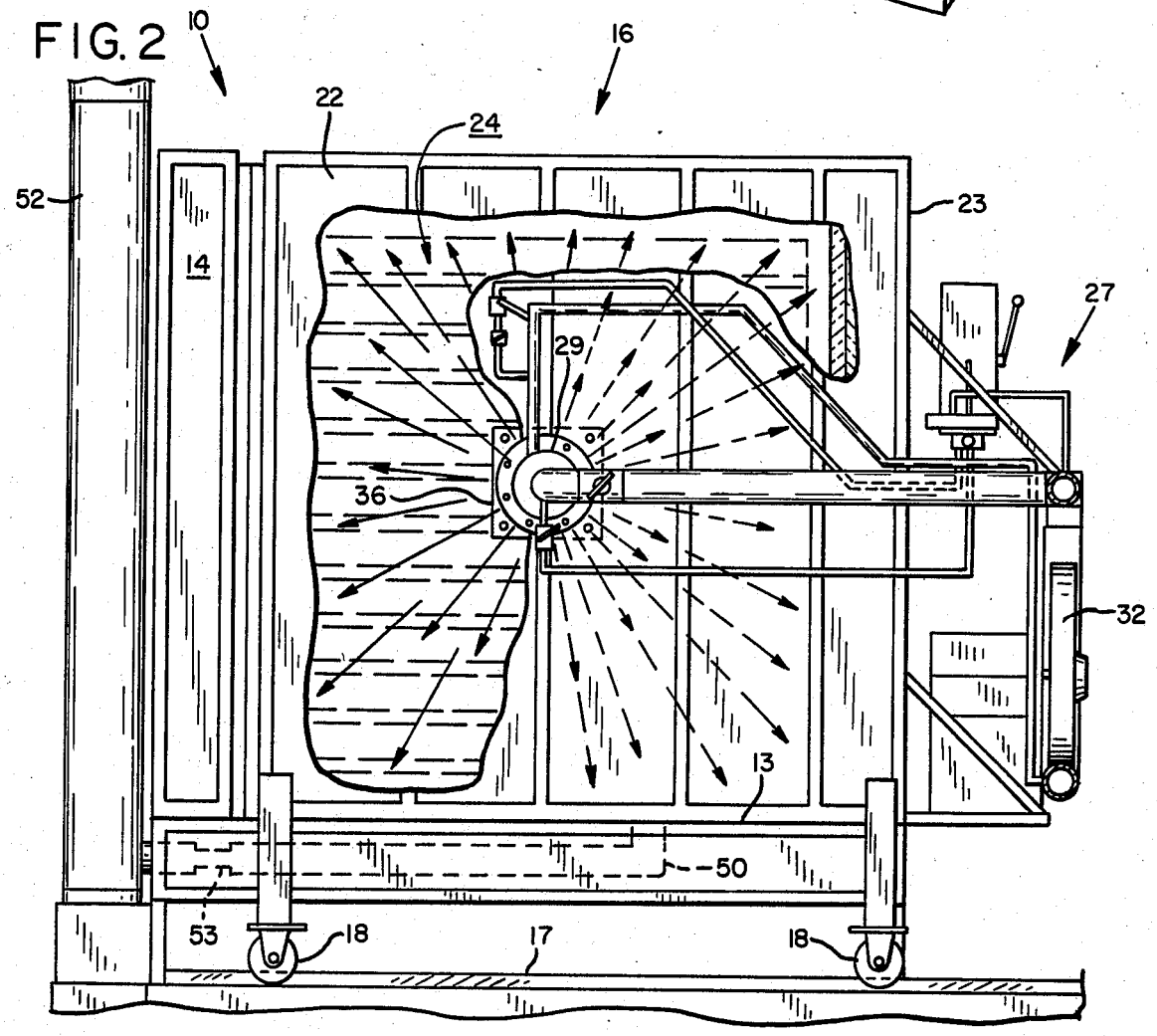

KILN WITH IMPROVED HEAT DISTRIBUTION

BACKGROUND OF THE INVENTION

The invention relates to furnaces such as kilns used for firing ceramic wares, brick work, and the like.

In the final stages of fabrication, ceramic wares are heated or "fired" in a kiln to achieve their final hardened condition and to cure the glazes applied to the wares' surfaces. Many complex changes take place during the firing stage in the ceramic material itself and in the glaze. Water and absorbed gases are driven out of the ceramic material, microscopic structural rearrangements occur, and chemical reactions occur in the glazes. If the firing is not performed properly, the wares can crack or even explode, and the glazes can run or yield false, unexpected colorations.

The changes which take place during firing are highly sensitive to temperature. Numerous firing schedules, according to which the wares are fired for prescribed periods in prescribed temperature ranges, have been specially devised to facilitate the changes. For reliable and reproducible results the wares must be subjected to uniform, accurately controlled temperatures.

Typical kiln operation has three stages: a preheat stage, a soak stage, and a cooling stage. In the initial, preheat stage the kiln temperature is gradually increased from ambient room temperature to the soak temperature, at which the wares cure. During the preheat stage the elements providing the heat source for the kiln are fired at only a fraction of their maximum capacity. In the soak stage the kiln heating chamber is maintained at a constant high temperature or, according to some firing schedules, is advanced over several distinct high-temperature levels. During the soak stage the wares undergo the various chemical and physical processes producing the final hardened condition of the wares and/or glazes. In the final cooling stage the wares are gradually cooled to a temperature which will allow the kiln to be opened and unloaded.

For proper firing the wares must be heated gradually and uniformly. Local regions of overheating or underheating can produce wares having weak spots or discoloration. Excessive overheating can cause the wares to crack or explode. Kilns are typically heated by introducing heated gas either from a burner or electrical heating unit. The regions of the kiln heating chamber in the vicinity of the ports at which heated gas is introduced into the chamber naturally tend to be hotter than other regions of the chamber. These regions are inherent hot spots in any kiln construction. Wares positioned close to the gas-entrance ports tend to cure differently from wares stacked in the inner portions of the heating chamber. Several methods have been attempted in the past to counteract this natural tendency and to provide a more uniform and controllable temperature distribution throughout the heating chamber.

In one primitive approach, sacrificial wares are placed on the shelves or racks in the vicinity of the heat source so as to shield the other wares. It is expected that the sacrificial wares will be improperly fired and may even crack, but they nevertheless serve to protect the remaining contents of the heating chamber. This method is wasteful and uncontrollable. The full shelf space of the kiln is not utilized for producing finished wares, and cracking of the sacrificial wares is unpredictable. Whether or when a sacrificial ware may crack and fail to provide adequate shielding is beyond control.

In another approach a baffle arrangement of one kind or another shields the wares to be fired from the heating source. A common baffle arrangement is the bag wall. A typical bag wall is constructed of fire brick stacked sideways to form a wall somewhat removed from the burners providing the heat source and extending from the kiln floor to the level of the burners. The bag wall shields the wares within the heating chamber from direct contact with the flame or flow of heated gas from the burners. The bag wall may also be used in an attempt to control the uniformity of the temperature distribution within the usable region of the heating chamber. Selected bricks may be removed from the bag wall to open up holes through which the heated gas may flow. Control over the circulation of the heated gas in this manner provides some measure of control over the uniformity of the temperature distribution.

In a typical operation the wares are loaded onto shelves or racks within the kiln heating chamber and subjected to heat for an extended period of time, sometimes as long as several days. During this time the kiln remains sealed until the firing is complete, so that further wares cannot be added during the firing process. Thus, shelf space, empty at the time the kiln is fired, remains empty until the next firing. For a commercial kiln unused shelf spce, or heating chamber volume dedicated to a bag wall or the like, represents a loss of potential profitability. It also represents a loss of fuel economy since roughly the same quantity of fuel must be expended throughout the firing process whether the racks for the wares fully or partially occupy the heating chamber volume and whether the racks are fully or partially loaded with wares. Known kiln constructions and arrangements for controlling the heat flow either do not achieve a high degree of temperature uniformity or do so only at the sacrifice of valuable heating chamber volume.

SUMMARY OF THE INVENTION

The present invention provides a kiln which produces a remarkably uniform temperature distribution within the kiln heating chamber without having to dedicate valuable heating chamber volume to dead space, sacrificial wares, bag walls or other baffle arrangements.

The invention may be practiced in any kiln in which the heat source is provided by a comparatively high-velocity flow of heated gas introduced into the kiln heating chamber through an orifice in a chamber wall. Briefly, a kiln according to the invention comprises a deflection means which is positioned proximate to, yet spaced apart from, the chamber wall and overlying the orifice in the path of the high-velocity flow. The deflection means has a characteristic transverse dimension which is sufficiently large so as to deflect the high-velocity flow in a direction which is substantially parallel to the chamber wall. The characteristic transverse dimension of the deflection means is also sufficiently small so as not to introduce appreciable drag into the high-velocity flow. It is found that with the dimensions and positioning of the deflection means selected in this manner the heated gas follows a radically different flow path from that followed by gases in known kilns. An unexpected consequence of this flow path is that a surprisingly uniform temperature distribution is achieved throughout the working region of the kiln where the wares are stacked.

Not only is the temperature uniformity improved, but also the available stacking area within the heating chamber is greatly increased. The deflection means according to the invention protrudes much less into the working region and requires less surrounding dead space than known gas deflection means. The present invention allows 85 to 95 percent of the heating chamber volume to be used for stacking wares.

With the improved heat distribution achieved by the present deflection means a kiln need have fewer heat sources than would otherwise be expected. A preferred embodiment of kiln is one of the downdraft variety having only two sources of heat, which are positioned in opposing side walls and which have associated deflection means. In this embodiment it is particularly desirable that each deflection means be tilted slightly with its upper extremity closer to the side wall than its lower extremity. The angled orientation of the deflection means compensates for the tendency of the hot gases to rise upon entering the chamber. A greater volume of the gases is directed out from the bottom extremity of each deflection means than from the top to balance the heat distribution in substantially all directions radially from the deflection means, the gas flow being generally parallel to the adjacent wall. The result is a substantially uniform atmosphere under a positive chamber pressure, promoting greater efficiency while avoiding local overheating and underheating and later cooling shock.

In a preferred embodiment of a small-sized kiln, a single deflection means oriented parallel to the top wall suffices to provide a comparatively uniform temperature distribution throughout the heating chamber.

A further understanding and appreciation of the invention and its objects and advantages will be gained by reference to the remaining portions of the specification and the accompanying drawings.

BRIEF DESCRIPTION OF THE DRAWINGS

FIG. 1 is a perspective view of an improved envelope-type kiln according to the invention in open position loaded with ceramic wares.

FIG. 2 is a left side elevational view of the kiln of FIG. 1 in closed position, partially broken away, depicting the flow path of the heated gases.

DETAILED DESCRIPTION OF PREFERRED EMBODIMENTS

Figure 3:
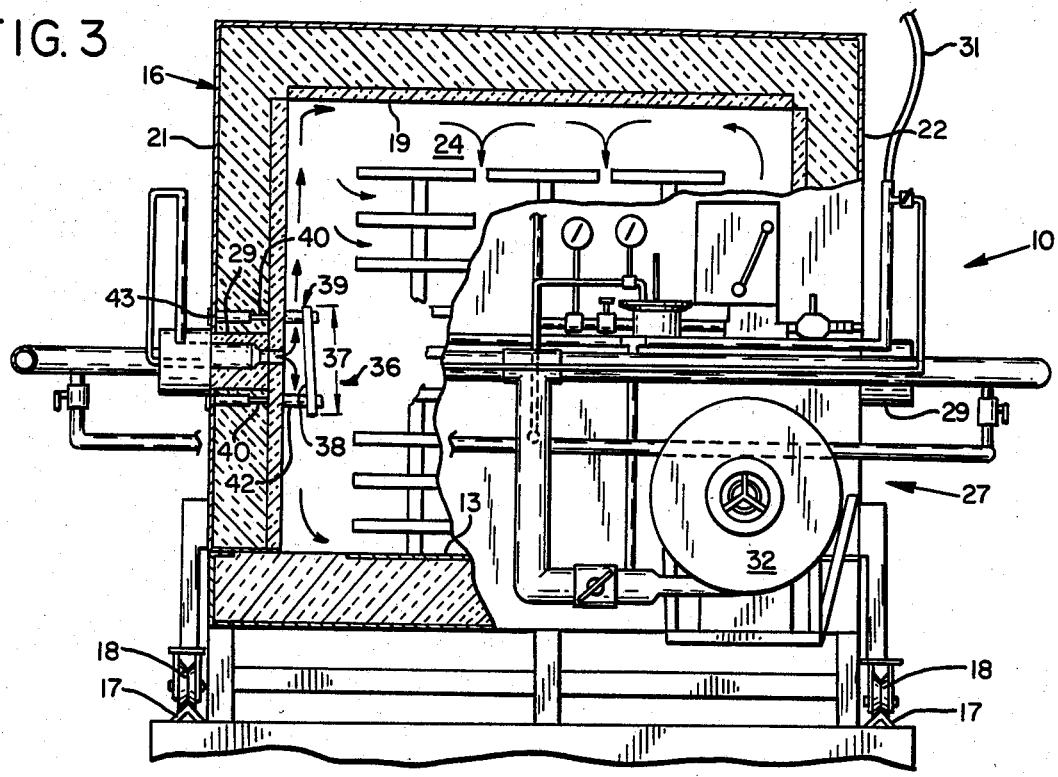
FIG. 3 is a front elevational view of the kiln of FIG. 1 in closed position, partially broken away to expose a side elevational view of the deflection means according to the invention.

An improved kiln according to the invention will be described and illustrated herein with specific reference to an envelope-type kiln for firing ceramics. It is to be understood, however, that the invention also embraces kilns of other constructions, and no limitation to an envelope-type kiln is intended. With the teachings provided herein those skilled in the art will readily be able to adapt the present improvement to other types of kilns.

FIG. 1 shows an envelope-type ceramics firing kiln 10 in open position with ceramic wares 11 stacked on a stationary portion 12 having a platform 13 and an end wall 14. A movable housing 16 is mounted on rails 17 via wheels 18 and includes a top wall 19, a pair of left and right side walls 21 and 22, and a front wall 23 (see also FIGS. 2, 3 and 4). As is typical of envelope-type kilns, movable housing 16 is open at the bottom. It can be wheeled along rails 17 into closed position over stationary platform 13. In this position the walls 13, 14, 19, 21, 22 and 23 define the kiln heating chamber, which is designated by reference numeral 24 in FIGS. 2–4. As is typical in the art, the walls defining the chamber are fully insulated with refractory material such as lightweight panels of a fibrous ceramic material.

The heating chamber 24 is brought up to, and maintained at, the desired temperature by introducing heated gas therein at a high velocity, as explained more fully below. In the kiln illustrated in the drawings, the means for introducing the flow of heated gas into chamber 24 is provided by a gas-fueled combustion heating system, indicated generally at 27, which includes a pair of burners 29 mounted at the side walls 21 and 22. In the illustrated kiln the burners introduce combusting gases through orifices 30 in the side walls 21 and 22. The front elevational view of FIG. 3 shows portions of the combustion heating apparatus 27 for delivering combusting gases to the kiln chamber. The apparatus includes a flexible fuel gas supply line 31 (FIGS. 1 and 3) leading to the movable kiln housing 16, a motor turbo blower 32, appropriate piping, valves and electrical equipment, and air/gas mixing apparatus included in the burners 29. Burners 29 are of the tempered variety, which, for example, introduce the combusting gases into the chamber at a velocity on the order of 150 miles per hour (mph). Such burners are manufactured, for example, by Eclipse, Inc. of Rockford, Ill., and are identified as Series MVTA. In combination with other described apparatus, the burners create an internal chamber pressure of approximately 2 to 5 inches of water.

Against this background the improvement of the present invention will now be described. Deflection means 36 is positioned proximate to each orifice 30 in overlying configuration so as to deflect the heated gas as it is introduced into chamber 24. The deflection means is said to "overlie" the orifice when the orifice is positioned opposite a deflecting surface of the deflection means. The term "overlie" is used irrespective of spatial orientation, so that the deflection means will be said to overlie the orifice even when the orifice is in a top wall and the deflection means lies beneath the orifice. It has been discovered that with proper choice of the dimensions and positioning of the deflection means 36, heated gas introduced at a comparatively high velocity will be deflected in a direction substantially parallel to the facing wall and radially outward from the deflection means. Moreover, this flow path maintains substantial integrity over an area of the wall many times larger than the area of the deflection means. The result is the formation of a "blanket" of heated gas along the wall, which gently heats the interior regions of chamber 24 and produces a surprisingly uniform temperature distribution within the working region of the heating chamber.

The relative dimensions and positioning of the deflection means are critical for realizing the benefits of the invention. Deflection means 36 and orifice 30 each have a characteristic transverse dimension—for example, the effective diameter of the orifice and the dimension indicated at 37 in FIG. 3. The deflection means 36 is spaced apart from the wall adjacent to the orifice by a characteristic spacing. It has been found that when the heated gas is introduced into the chamber at 150 mph, deflection of the gas flow according to the invention will be achieved when the characteristic spacing is comparable with or somewhat larger than the characteristic dimension of the orifice. The term "proximate" is used herein to describe the positioning of the deflection means with respect to the orifice and is understood to embrace this relationship. For example, it has been found that with a gas entrance velocity of 150 mph and a burner port of 1½-inch diameter, the characteristic spacing should be 1½ to 2½ inches.

An exact analytical relation among all the parameters affecting the performance of the deflection means is not known. However, when the gas entrance velocity, entry port dimension and deflection means spacing are selected in the relationship just described, the characteristic transverse dimension of the deflection means may be determined empirically. If this transverse dimension is too small, the overall gas flow will not be deflected through a sufficient angle to produce a flow parallel to the wall. For a critical size the deflection means will produce the desired parallel flow. As the characteristic dimension is increased further beyond the critical size, a drag is introduced into the flow. If the characteristic dimension is too large, then sufficient drag is introduced that the parallel flow will fail to maintain its integrity much beyond the extremities of the deflection means. Moreover, there is a tendency for local hot spots to develop at the wall directly behind the deflection means. Thus, the size of the deflection means characteristic transverse dimension may be empirically selected between limits so as to deflect the flow into a flow path parallel to the wall, yet so as not to introduce appreciable drag into the flow. Small amounts of drag can be tolerated without nullifying the benefits of the invention. When the drag becomes appreciable, however, the flow fails to maintain integrity over a substantial portion of the adjacent chamber wall, and the benefits of the invention will not be realized.

In the specific example of a 150-mph gas entrance velocity, 1½-inch orifice diameter, and 1½ to 2½-inch spacing, the deflection means was taken to be square having a critical characteristic transverse dimension of 9 inches on a side.

The precise manner in which the deflection means achieves its effect is not known. However, it is believed that the deflection means cooperates with the adjacent wall to create a channel for propelling the streaming gas radially outward. A channel of characteristic width (the spacing referred to above) and length most likely generates an approximately laminar, highly stable flow of gas along the wall. The velocity of the gas is an important characteristic. During the preheat stage of operation, the flaming gas is introduced into the chamber at a low velocity and with a comparatively cool flame temperature. In this stage the deflection means merely acts as a baffle, serving to prevent direct contact of the flame with the wares. The flow path characteristic of the invention is not achieved. In the soak stage the velocity of the heated gas is increased to a level at which the deflection means produces the desired flow path. To distinguish between the preheat and soak stages, the gas velocity in the soak stage is referred to herein as "high velocity." In other contexts persons skilled in the art will occasionally refer to an entrance velocity of 150 mph as a medium velocity to distinguish nozzles producing much higher entrance velocities. The meaning attributed to "high velocity" in the present context is not to be confused with such other usages of the term.

Figure 4:
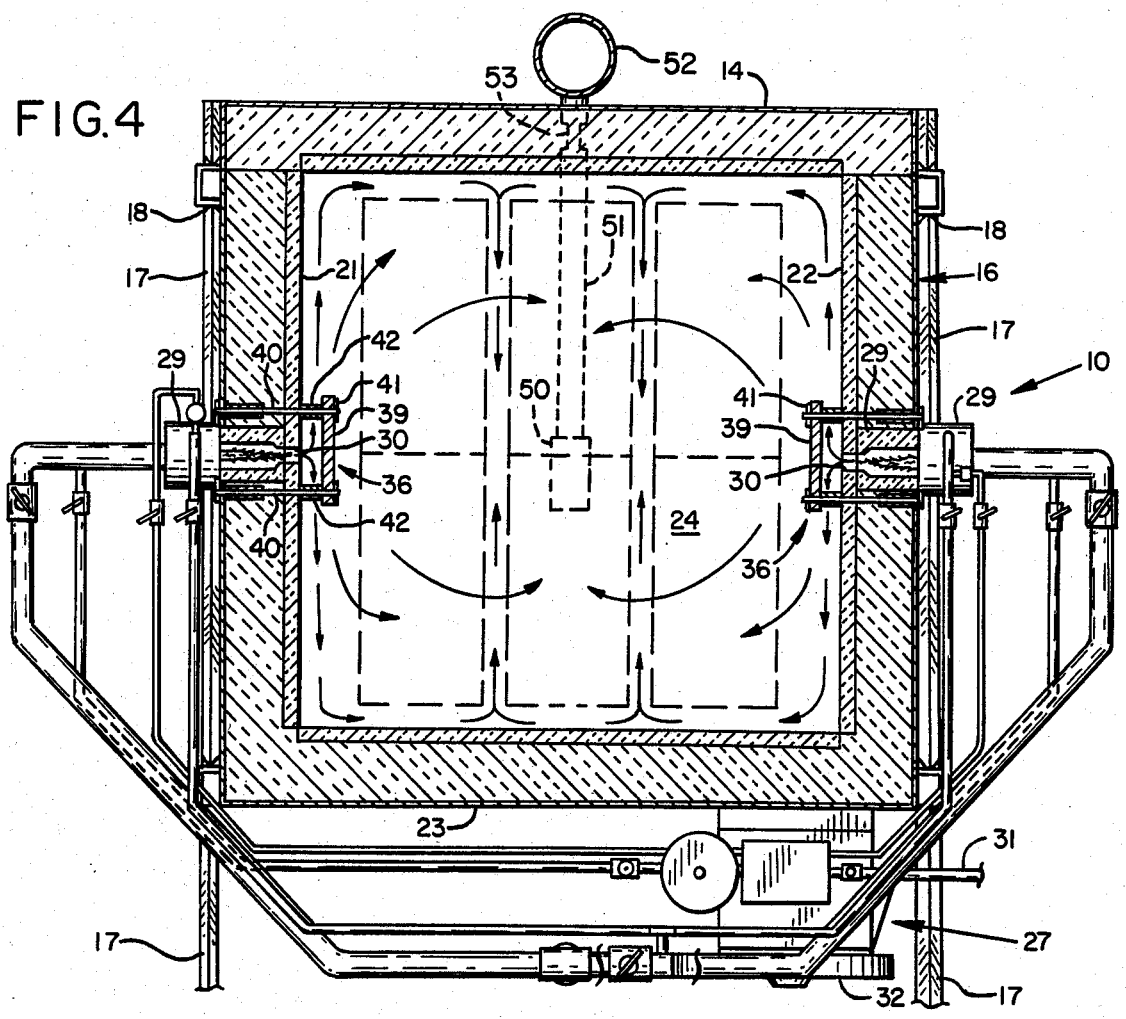
FIG. 4 is a top cross-sectional view of the kiln of FIG. 1 in closed position showing the kiln heating chamber and gas flow path.

Each of the deflection means 36 may be formed to present a substantially flat portion to the facing wall, for example, the face 38 of plate member 39 shown in FIGS. 3 and 4. In operation, the flat portion 38 will be subjected directly to the high velocity flame of the combusting gases and, consequently, must be formed of a sufficiently durable material. Plate member 39 may be advantageously formed of a rigid ceramic fiber board, which may be comprised of 75% alumina and 19% silica, with a thickness of about an inch. Those skilled in the art will recognize that other materials, such as zirconium fiber board, can also be used. Plate member 39 is secured to the adjacent wall by four ceramic spikes 40, each roughly ⅜-inch in diameter, extending through plate member 39. Each spike has a ceramic head or equivalent fastener 41 at its inwardly facing end for mounting the deflection means in position. Insulating spacers 42 composed of ceramic fiber material surround each spike 40 for protection against direct flame contact and local overheating. Spacers 42 also serve to maintain the deflection means at the proper spacing and angle with respect to the facing wall, as explained below. Each of the spikes 40 extends through the kiln wall into a matching stainless steel anchor 43, which may be bolted to the kiln frame.

Figure 6:
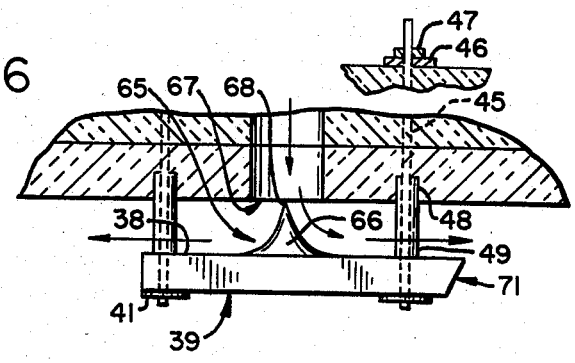
FIG. 6 is an elevational view, partially in section, of an alternative embodiment of deflection means according to the invention.

Alternatively, plate member 39 may be held in position in a manner enabling both the spacing and angle of tilt of the deflection means to be selectively adjusted. As illustrated in FIG. 6, the adjustment means may comprise selectively extendable set screws 45 secured by stainless steel anchor 46 and lock nut 47. Set screw 45 will generally become hot during the operation of the kiln and so is provided with a screwdriver slot in its outer end for adjustment. The inner wall is formed with a recess 48 for receiving insulating member 49. Unlike spacers 42, in this embodiment the member 49 serves only an insulating function.

The arrangement of heat source and deflection means described above provides sufficiently improved heat distribution and fuel economy that the number of burners conventionally required to heat a kiln can be reduced. FIGS. 1–4 illustrate a kiln providing a heating chamber with a working volume of 58 cubic feet, yet having only two burners and associated deflection means mounted in opposing side walls. Conventional kilns with a working volume of this magnitude either employ more numerous burners or more complex burner arrangements. The gas entrance ports 30 are preferably located in the vicinity of the center of each wall. When deflection means 36 is mounted on a side wall, it has been found advantageous to mount the deflection means so that it deviates slightly from a truly parallel relation to the side wall. As seen in FIG. 3, the deflection means is tilted with respect to the vertically oriented side wall so that the flat portion of plate member 39 is spaced farther fom the side wall at its lower extremity than at its upper extremity. In the embodiment described above with a nine inch square plate member, the upper extremity of the plate member is spaced about two inches from the wall and the lower extremity is spaced about 2½ inches from the wall. Both the top and bottom edges of the plate member are parallel to the wall. Thus, the angle of tilt is approximately 3½°. The angle of tilt has been exaggerated in FIG. 3 for the sake of illustration. With the deflection means tilted in this manner, a slightly greater portion of heated gas is deflected downward than upward. This inequality in the proportion of heated gas directed downward and upward is found to counteract the natural tendency of heated gas to rise. Thus, the angle of orientation of side wall-mounted deflection means contributes to the uniformity of the resulting temperature distribution in the working region of the heating chamber.

In operation, it is found that when heated gas is introduced into the chamber at sufficiently high velocity, deflection means 36 disperse the gas over substantially the entire surfaces of the walls, producing a uniform penetration of heat into the working region of the heating chamber. The flow path of the heated gas is indicated by the arrows in FIGS. 2–4. As indicated in FIG. 2, the heated gases are distributed in all directions along the adjacent wall radially outward from deflection means 36. The front elevational view of FIG. 3 illustrates the progress of the heated gases up and down the side walls as they engage floor 13 and ceiling 19. The top cross-sectional view of FIG. 4 shows the flow path engaging the back and front walls 14 and 23. Although the primary flow of gas is along the walls to form an enveloping blanket of heated gas, heat from this blanket is convectively dispersed among and through the stack of loading shelves from all sides simultaneously to produce a temperature distribution which is remarkably uniform. After circulating through the loading shelves and among the ceramic wares being fired, the heated gas exits the kiln heating chamber through floor outlet vent 50, shown in dashed lines in FIGS. 2 and 4. Outlet vent 50 and a connecting channel 51 beneath floor 13 communicate with exhaust stack 52 shown in FIGS. 1 and 4. Outlet vent 50 is sized to cooperate with the entrance velocity of the heated gas through orifices 30 to produce the desired internal chamber pressure indicated above. The proper outlet size for a given gas entrance velocity in any particular kiln may readily be determined by those skilled in the art. Exhaust channel 37 may include a constricted region, as indicated at 53, to help establish and maintain a desired chamber pressure.

Figure 5:
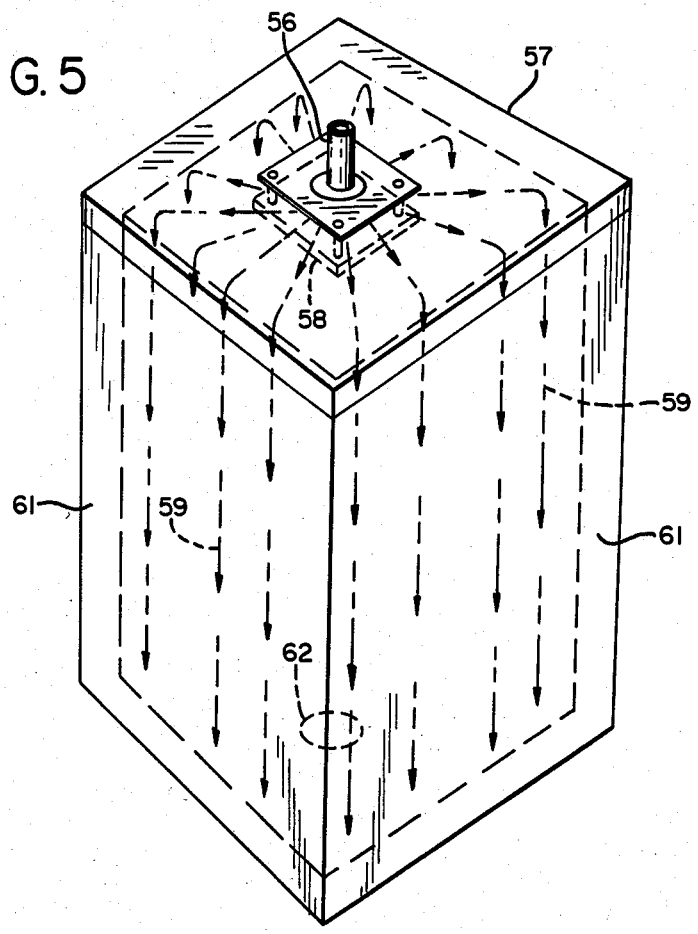
FIG. 5 is a perspective schematic view of an alternative embodiment of a kiln according to the invention having only a single burner.

With the improved operation achieved by the burner/deflection means arrangement of the present invention, an efficient, cost-effective, small-sized kiln may be fashioned, which is convenient for individual use. Such an embodiment of a kiln is shown in FIG. 5. The kiln of FIG. 5 includes a single burner 56 disposed in a removable top 57. Deflection means 58 is mounted proximate to and parallel to the inwardly facing surface of the top 57. The arrows 59 show the flow path of the heated gases along the top wall and down side walls 61 toward the bottom exhaust opening 62. Burner 56 is mounted centrally in top 57. Although a cubic configuration is illustrated in FIG. 5, the kiln side walls can equivalently be cylindrical—a common shape for small, removable-top kilns. A single burner and deflection means mounted in the top has been found to operate efficiently in a kiln having a volume of 27 cubic feet or smaller, so as to provide the benefits of the present invention.

Some improvement in the performance of the deflection means may be achieved if the deflection means further comprises means for directing the heated gas incident upon the deflection means into a perpendicular flow direction to produce the characteristic flow along the chamber walls. As illustrated in FIG. 6, the gas-directing means comprises a member 65 positioned on the substantially flat face 38 of plate member 39. The member 65 is formed to present a generally conical surface 66 to orifice 67. The apex 68 of the surface 66 is positioned opposite the center of orifice 67. The generally conical surface is preferably formed with a concave curvature. Formed in this manner, the gas-directing means helps the in-coming gas to make a smooth change of direction through an angle of roughly 90 degrees without the formation of undesirable turbulent eddies, which tend to reduce the effectiveness of the flow.

Further improvement in the performance of the deflection means can also be achieved by beveling the edges of plate member 39 as shown at 71 in FIG. 6, so that the bevel faces outward from the adjacent wall. This orientation of the bevel is referred to herein as a positive bevel. The beveled edges assist in maintaining the integrity of the flow over a larger wall area. It is noted that if plate member 39 with beveled edges is positioned too close to the adjacent wall, a local hot spot tends to be formed at the wall somewhat beyond the beveled edge.

Thus far the operation and advantages of the present invention have been described in terms of the deflection of high-velocity heated gases in the soak stage and the resulting uniform distribution of heat. The deflection means according to the invention also proves to be of advantage during the cooling stage of operation. A high-velocity flow of cool air directed through orifices 30 during the cooling stage will also be deflected in the same manner as the heated gases. It is found that cool air admitted to the heating chamber in this manner uniformly purges the hot air from the chamber. This greatly reduces the formation of any substantial localized cold spots within the working volume of the chamber and substantially reduces the risk of cooling shock to the wares. For deflection means mounted in tilted configuration to overlie an orifice in a side wall, it has been found advantageous to maintain the same angle of tilt during the cooling stage as in the soak stage.

While the above provides a full and complete disclosure of the preferred embodiments of the present invention, various modifications, alternate constructions, and equivalents may be employed without departing from the true spirit and scope of the invention. For example, other arrangements for securing or positioning the deflection means to its facing wall and for adjusting the spacing and tilt will readily occur to those skilled in the mechanical arts. Moreover, although the invention arose out of, and was illustrated with respect to, a kiln for firing ceramic wares, given the benefit of this disclosure, those skilled in the art will recognize other applications of the invention to kilns or furnaces operating under similar conditions to those described above, but used for heating other types of objects. Therefore, the above description and illustration should not be construed as limiting the scope of the invention, which is defined by the appended claims.

What is claimed is:

1. In a kiln having a heating chamber for heating objects disposed therein, said chamber being defined at least in part by a wall having an orifice therein and said kiln including means for introducing a high-velocity flow of heated gas into said chamber through said orifice for heating said chamber, the improvement comprising:

deflection means for deflecting said high-velocity flow along said wall, said deflection means being positioned proximate to said wall in spaced-apart relation thereto and overlying said orifice in the path of said high-velocity flow, said deflection means having a characteristic transverse dimension sufficiently large so as to deflect said high-velocity flow in a direction substantially parallel to said wall over an area thereof substantially larger than said deflection means and sufficiently small so as not to introduce drag into said high-velocity flow of a magnitude destroying the integrity of said substantially parallel flow over said area, whereby a substantial and integral flow of heated gas is maintained along said wall for heating said chamber.

2. The kiln of claim 1, wherein said deflection means comprises a member having a substantially flat portion facing said orifice.

3. The kiln of claim 2, wherein said wall is vertically disposed to form a side wall of said chamber, and said member is tilted with respect to said side wall so as to be spaced farther from said side wall at a lower extremity of said member than at an upper extremity thereof, whereby a greater portion of said high-velocity flow is deflected downward than upward to counteract the natural tendency of heated gas to rise and thereby produce a substantially uniform distribution of heat over said wall.

4. The kiln of claim 2, wherein said wall is disposed to form a top wall of said chamber, and said substantially flat portion is uniformly spaced apart from said top wall thereby to produce a substantially uniform distribution of heat over said top wall.

5. The kiln of claim 2, further comprising adjustment means connected to said deflection means for adjusting the spacing of said member from said wall.

6. The kiln of claim 5, wherein said adjustment means comprises a plurality of selectively extendable members positioned about the periphery of said deflection means, whereby both the overall spacing and angle of tilt of said substantially flat portion can be adjusted.

7. The kiln of claim 1, wherein said deflection means further includes gas-directing means presenting a generally conical surface to said orifice, said generally conical surface having an apex centrally disposed opposite said orifice.

8. The kiln of claim 7, wherein said generally conical surface is further formed to be concave.

9. The kiln of claim 2 wherein said member is formed with positively beveled edges at the outer extremities thereof.

10. A kiln suitable for individual use comprising:

means defining a heating chamber having a volume no greater than about 27 cubic feet, said means including a top wall having an orifice disposed generally centrally within said top wall;

a single heating means for introducing a high-velocity flow of heated gas into said chamber for heating said chamber, said heating means introducing said flow of heated gas through said orifice; and deflection means for deflecting said high-velocity flow along said wall, said deflection means being positioned proximate to said wall in spaced-apart relation thereto and overlying said orifice in the path of said high-velocity flow, said deflection means having a characteristic transverse dimension sufficiently large so as to deflect said high-velocity flow in a direction substantially parallel to said wall over an area thereof substantially larger than said deflection means and sufficiently small so as not to introduce drag into said high-velocity flow of a magnitude destroying the integrity of said substantially parallel flow over said area, whereby a substantial and integral flow of heated gas is maintained along said wall for heating said chamber.

* * * * *